US006345492B1

(12) United States Patent
Lüscher et al.

(10) Patent No.: US 6,345,492 B1
(45) Date of Patent: Feb. 12, 2002

(54) ARTICULATED BRACELET WITH LIMITED BENDING

(75) Inventors: Denis Lüscher, Grenchen; Christophe Guerry, Oberbuchsiten; Sëbastien Bolzt, Moutier; Michael Bach, Biel, all of (CH)

(73) Assignee: Montres Rado S.A., Lengnau (CH)

( * ) Notice: Subject to any disclaimer, the term of this patent is extended or adjusted under 35 U.S.C. 154(b) by 0 days.

(21) Appl. No.: 09/804,307

(22) Filed: Mar. 13, 2001

(30) Foreign Application Priority Data

Mar. 22, 2000 (CH) ..... 0544/00

(51) Int. Cl.[7] ..... F16G 15/00; A44C 05/10
(52) U.S. Cl. ..... 59/80; 59/78; 63/4
(58) Field of Search ..... 59/78, 80, 93; 63/3, 4, 9

(56) References Cited

U.S. PATENT DOCUMENTS 1,357,139 A * 10/1920 Bayardi ..... 59/80
4,840,044 A * 6/1989 Scholpp ..... 63/4
4,930,304 A * 6/1990 Meister ..... 59/80
5,347,498 A * 9/1994 Loth et al. ..... 59/80
5,365,753 A * 11/1994 Carrola ..... 63/4

FOREIGN PATENT DOCUMENTS

| | | |
|---|---|---|
| CH | 684 988 A | 2/1995 |
| EP | 0 030 705 A | 6/1981 |
| FR | 2 567 728 A | 1/1986 |

* cited by examiner

*Primary Examiner*—David Jones
(74) *Attorney, Agent, or Firm*—Griffin & Szipl, P.C.

(57) ABSTRACT

The bracelet is formed of decorative elements (10) mounted on the links (20) of a chain (20). Each decorative element (10) includes over a portion of its length a central rib (16) and two lateral edges (18) connecting the cap (13) and feet (17, 19) made as an overthickness on the bottom (15). Each link includes on either side of a slot (2) two coupling elements (21, 31) connected by a bridge (7) provided with a pin hole (9), each having a lateral arm (28, 38) provided with a pin hole (29, 39) and forming with the bridge (7) a complementary recess (23, 33) of an extension (24, 34) provided with a pin hole (25, 35) at the other end. The bending of one link with respect to the following one is limited by blocking means provided either at the opposite pin holes or at recesses and extensions.

6 Claims, 4 Drawing Sheets

ARTICULATED BRACELET WITH LIMITED BENDING

The present invention concerns a non-extensible articulated bracelet, in particular for a watch, including a plurality of decorative annular elements which are sensitive to compression or shocks, said decorative elements being strung onto a central core formed by an inner chain of links connected to each other by pivoting axes and designed to co-operate with each other and with the decorative elements to prevent any accidental compression or shock from breaking said elements.

The invention concerns more particularly a bracelet of this type wherein the decorative elements are made of a material having very high resistance to abrasion, but lower resistance to shocks, such as ceramic based composites.

Non-extensible bracelets having a central core, made of a base material with an essentially mechanical function, completely or partially masked by a decorative outer element made of free links made of a more noble material have already been disclosed in various documents of the prior art, certain of which also have the object of preventing excessive bending likely to damage the outer element.

French Patent No. 2 502 916 discloses a watch bracelet formed of an inner chain onto which decorative elements, open on the wrist side, are freely strung on. The inner chain is formed of solid links each including a stud portion and a slot portion to allow them to be fitted inside each other and keeping them assembled by means of a pin. The face of the stud opposite the slot has a certain inclination in order to limit the range of movement of an inner link with respect to the next link to fit the natural curve of the wrist. Because of the play which must necessarily exist between each decorative element, when the bracelet is bent a decorative element may not cover the corresponding link of the inner chain perfectly and may be damaged when the bracelet is bent.

In order to overcome the aforecited drawback European Patent No. 0 549 979 proposes a device wherein the decorative elements are enveloping, leaving free a central passage provided laterally with stops and they are positioned precisely above each link by blocking bars. The opposite faces of the decorative elements have complementary rounded shapes but no means are provided, on the inner chain, able to limit the range of movement thereof, which does not eliminate the risk of breakage by excessive bending.

The non-extensible bracelet disclosed in European Patent No. 0 736 480 includes a relatively complex articulation device between two successive links including two pins connected by linking elements which also determine the authorised bending angle, each enveloping decorative element being held on this articulation device by an insert passing through said element and being held snap fitted by the pins.

The object of the present invention is to overcome the drawbacks of this prior art by providing a non-extensible articulated bracelet, wherein the links of an inner chain co-operate with each other and with the decorative elements strung onto them to prevent or limit the risk of said decorative elements being compressed when the bracelet is bent or in the event of an accidental shock, for example by dropping to the ground a watch fitted with such a bracelet.

The present invention therefore concerns a bracelet formed of enveloping decorative elements mounted on a non-extensible articulated inner chain formed of links the particular shape of which, by co-operating with the structures of the passages through the decorative elements, allows the angular range of movement of a link with respect to the next link to be limited to an angle $\alpha$ in a vertical plane passing through the longitudinal line of symmetry X–X' of the bracelet.

Each decorative element includes, on a part of the depth of the through passage, on the one hand a central rib, and on the other hand two lateral edges connecting the cap, i.e. the visible part, to feet made as an overthickness on the bottom, said feet forming two symmetrical grooves with respect to the line X–X'.

Each link includes a central slot which is complementary to the rib of a decorative element and the bottom of which forms a bridge through which a pin hole passes. The bridge connects two symmetrical coupling elements, the main body of which has a width substantially smaller than the distance between the central rib and a lateral edge. Each coupling element has at one end a lateral arm provided with a pin hole, extending beyond the main body over a distance corresponding to the thickness of one edge and forming with the bridge a recess which is complementary to an extension of the opposite end, through which a pin hole also passes. The edges of the pin holes or the edges of the recesses and extensions are provided with blocking means limiting the bending angle of a link with respect to the next link.

According to a first embodiment, the blocking means are formed at each end of the pin hole of the bridge by two annular stops having vertical shoulders which cooperate with annular stops provided at the ends facing the holes of the two extensions, said stops having shoulders forming an angle of less than 180° one being vertical on the cap side, the other being inclined at an angle $\alpha$ on the bottom side.

According to another embodiment the blocking means are formed at the end of each extension by a lug bent at an angle $\alpha$ on the bottom side, said lug co-operating with a recess of complementary shape, provided on the bottom side in the thickness of each coupling element and joining an edge of the recess.

It will also be observed that the presence of feet between the bottom and the edges and the rib allow a certain play enabling bending slightly greater than the value $\alpha$ to be absorbed, without exerting any stress on the decorative element.

Other advantages and features of the invention will appear more clearly upon reading the following description of embodiment examples given by way of illustrative and non-limiting example, with reference to the annexed drawings, in which.

Figure 1:
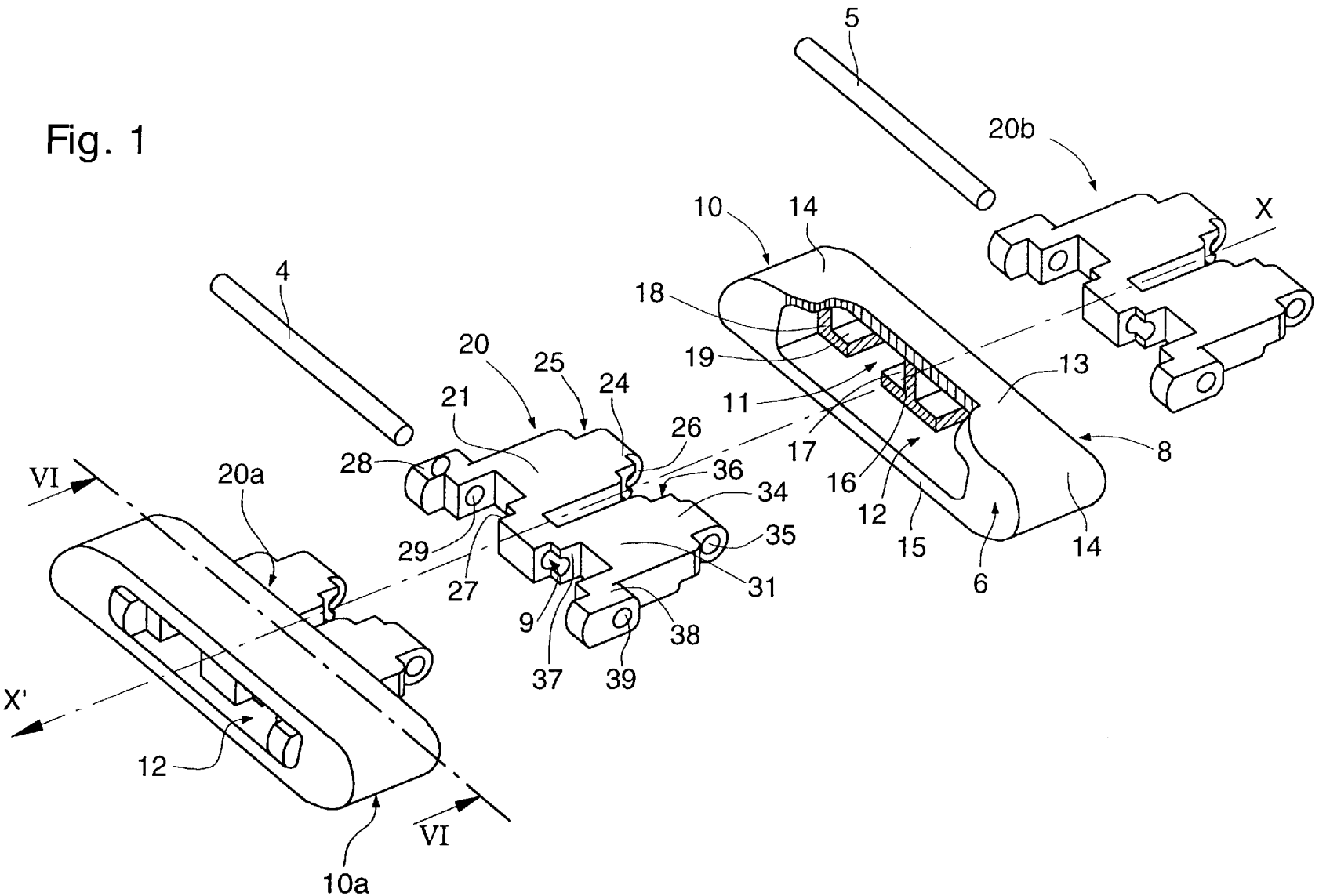
FIG. 1 is a blown up perspective view of the assembly of links with two decorative elements.

FIG. 1 shows in blown up perspective a portion of bracelet formed of two decorative elements 10 and 10*a* and three links 20, 20*a* and 20*b* aligned along a line of symmetry X–X', intended to be assembled by pivoting pins 4 and 5. First bracelet element 1 is shown with link 20*a* set in place in the direction X–X', in through passage 12 of decorative element 10*a*. In order to assemble second bracelet element 3, link 20 is engaged in link 20*a*, they are assembled by means of pin 4, then the following decorative element 10 is strung on, again in direction X—X. In the same way, the preceding process is repeated by engaging link 20*b* in link 20 and assembling them by means of pivoting pin 5.

Figure 6:
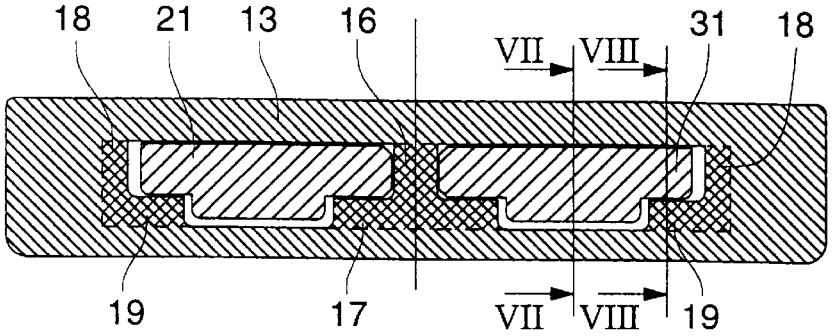
FIG. 6 is a cross-section of a decorative element, onto which a link is strung, at line VI—VI of FIG. 1.

Decorative element 10, which has the general shape of a flattened ring, is shown in partially torn away view to show more clearly the particular structure of through passage 12 from its front face 6 to its back face 8. It is delimited at its top portion, i.e. the visible portion, by a cap 13, at its bottom portion, which is in contact with a user's wrist by a bottom 15, these two portions being joined by rounded edges 14. From substantially half of its depth and up to its back face 8, through passage 12 has on the one hand a central rib 16 joining the inner wall of cap 13 and a foot 17 made as an overthickness on the inner wall of bottom 15, and on the other hand over each side an edge 18 joining cap 13 and a foot 19 made as an overthickness on bottom 15 in the same manner. Foot 17 of rib 16 delimits with feet 19 of edges 18 two symmetrical grooves 11 with respect to axis X–X'. This symmetrical structure appears more clearly in the cross-section shown in FIG. 6. FIG. 6 also shows that rib 16, edges 18 and feet 17, 19 greatly contribute to reinforcing decorative element 10 at the zones of support for coupling elements 21, 31, while having the possibility of keeping sufficient play on the one hand between the inner surface of bottom 15 and the opposite surface of main body 21, 31 of a link, and on the other hand between each edge 18 and the edges of the main body, while the bracelet elements are aligned perfectly along axis X–X' as a result of the co-operation of rib 16 and slot 2.

In the example shown, decorative element 10 has been given the simplest geometrical shape, but it is obvious that it may be given a different aesthetic appearance, for example by making the cap in a convex manner. Likewise, front and back faces 6 and 8 may have complementary enveloping shapes, as appears for example in the cross-sections of FIGS. 7A and 7B. This decorative element may be made in a single piece with any type of material, but one of the objects of the invention is to be able to use materials having an attractive appearance, good abrasion and scratch resistance, but yet less resistance to compression and shocks. A material of this type is for example a ceramic material which easily allows the desired shape to be obtained by moulding and sintering.

Figure 2:
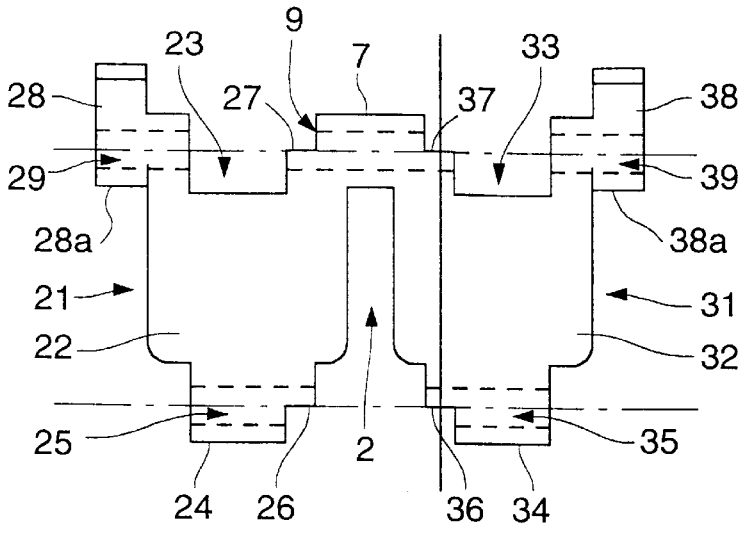
FIG. 2 is a top view of a link of the inner chain.
Figure 3:
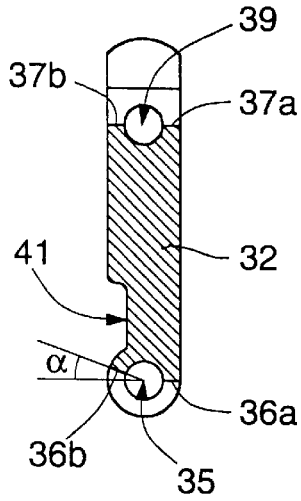
FIG. 3 is a cross-section along the line III—III of FIG. 2.

With reference now also to FIGS. 2 and 3, a link 20 of the inner chain will be described hereinafter. As can be seen, each link has a symmetrical structure on either side of a central slot 2 having as width the thickness of central rib 16 of a decorative element 10. The bottom of this slot 2 forms a bridge 7 which connects two coupling elements 21 and 31 and through which a pin hole 9 passes. Each coupling element 21, 31 is formed of a main body 22, 32 having a substantially smaller width than the space between central rib 16 and a lateral edge 18 of a decorative element 10. Each coupling element 21, 31 has, at one end a lateral arm 28, 38 extending transversely beyond main body 22, 32 over a length substantially equal to the thickness of an edge 18 of a decorative element 10, so that the vertical surface 28*a*, 38*a* turned towards the other end of main body 22, 32 rests on an edge 18 when a decorative element 10 is strung onto link 20. Pin holes 29, 39 aligned with pin hole 9 of bridge 7 pass through arms 28, 38 which delimit with the bridge 7 a substantially rectangular recess 23, 33 of complementary shape to an extension 24, 34 of the opposite end of main body 22, 32. The two extensions 24 and 34 are provided with pin holes 25 and 35 in alignment.

Figure 7A:
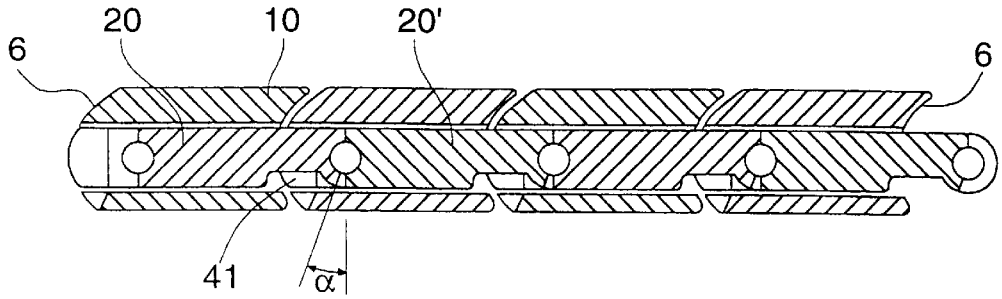
FIG. 7A is a cross-section, along the line VII—VII of FIG. 6, of four bracelet elements arranged flat.
Figure 7B:
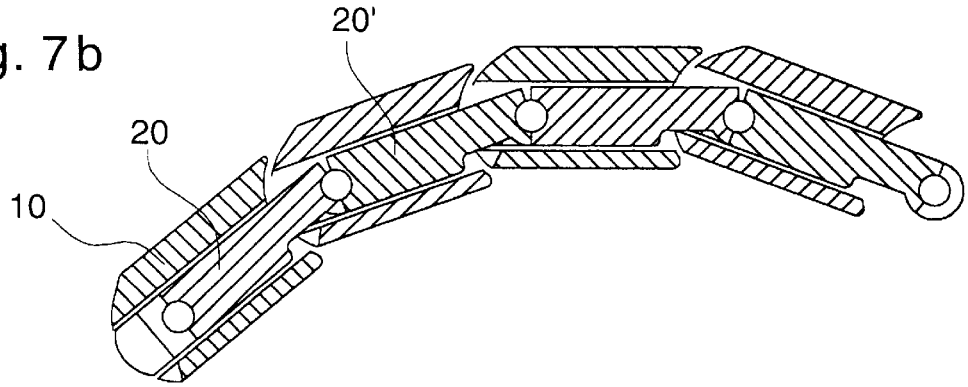
FIG. 7B shows the four bracelet elements of FIG. 7A in a bent position.

In the example shown in FIGS. 1 to 3 and 7A to 8B, the blocking means allowing the bending of a link with respect to the following link to be limited to an angle $\alpha$ are formed on the one hand at each end of pin hole 9 of bridge 7 and at the opposite ends of pin holes 25, 35 of extensions 24, 34 of the other end of main body 21, 31. These blocking means consist, at bridge 7, of an annular stop 37 (respectively 27) having vertical shoulders 37*a*, 37*b* at 180°, and at extensions 24, 34 of an annular stop 36 (respectively 26) having a vertical shoulder 36*a* on the side of cap 13 and a shoulder 36*b* inclined at an angle $\alpha$ on the side of bottom 15, the angular distance between these two shoulders 36*a*, 36*b* being less than 180°. The value of angle $\alpha$ obviously depends on the width of the bracelet elements and on the size of the wrist on which it has to be put, but it can be indicated by way of example that a mean value of 18° is entirely suitable. Thus, as shown in FIGS. 7A and 8A, when the bracelet is arranged flat, the shoulder 36*a* of a link 20 is in contact with the shoulder 37*b* of the following link 20', while shoulders 36*b* and 37*b* form an angle $\alpha$. Conversely when the bracelet is bent, shoulders 36*b* and 37*b* are in contact and shoulders 36*a* and 37*a* form an angle $\alpha$. In a similar manner, this blocking device can be provided at the ends of other pin holes.

Figure 8A:
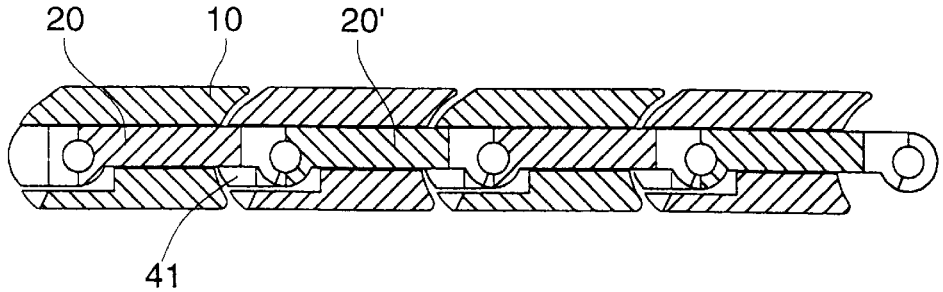
FIG. 8A is a cross-section, along the line VIII—VIII of FIG. 6, of four bracelet elements arranged flat.
Figure 8B:
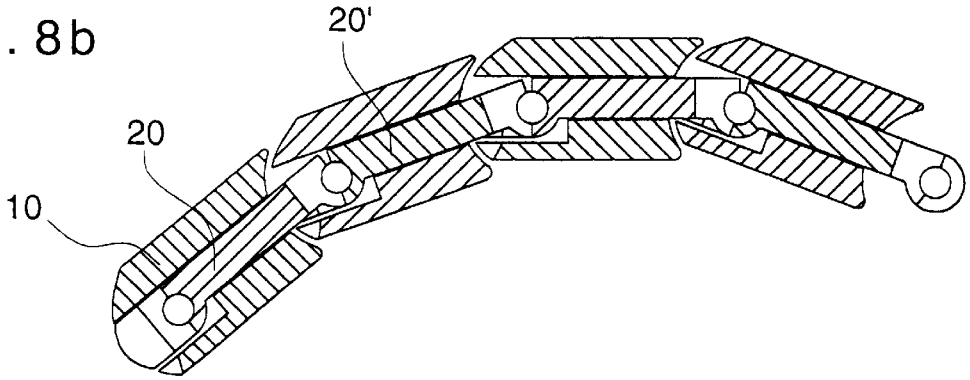
FIG. 8B shows the four bracelet elements of FIG. 8A in a bent position.
Figure 9A:
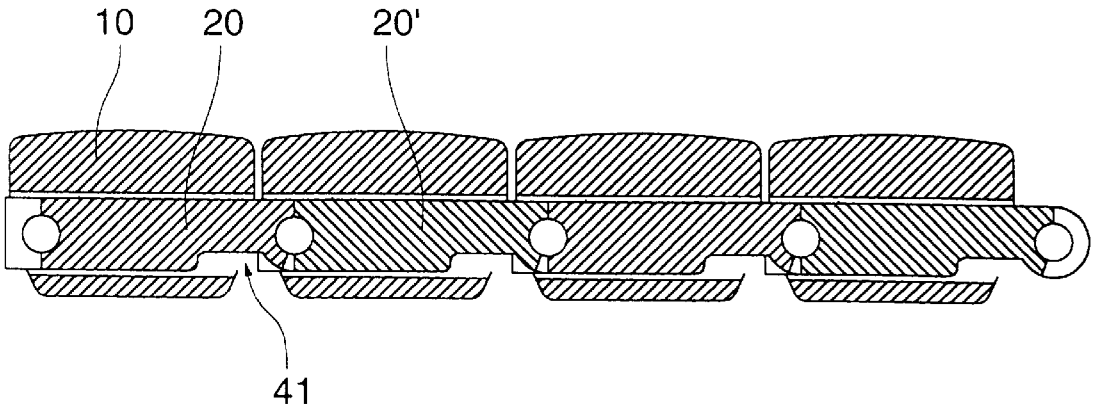
FIG. 9A shows, along an identical cross-section to that of FIG. 8A, four bracelet elements having other decorative elements.
Figure 9B:
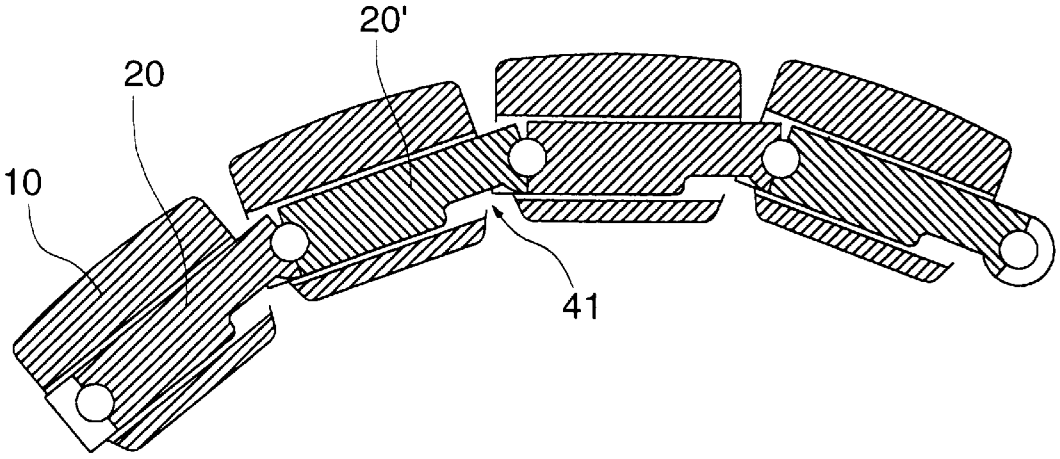
FIG. 9B shows the four bracelet elements of FIG. 9A in a bent position.

As is seen in particular in FIGS. 8A and 8B, front and back faces 6 and 8 of decorative elements 10 have complementary rounded shapes extending beyond the links which they cover, so that the portions forming the cap also cover the inner chain when the bracelet is bent. In order to allow range of movement for the bottom when the bracelet is bent, main body 22, 32 includes a hollow portion 41 after pin hole 25, 35. As can be seen in FIGS. 9A and 9B which correspond, along the same cross-section as FIGS. 8A and 8B, to another simpler embodiment wherein the caps do not cover each other, it may also be necessary to keep hollow portions 41.

Figure 4:
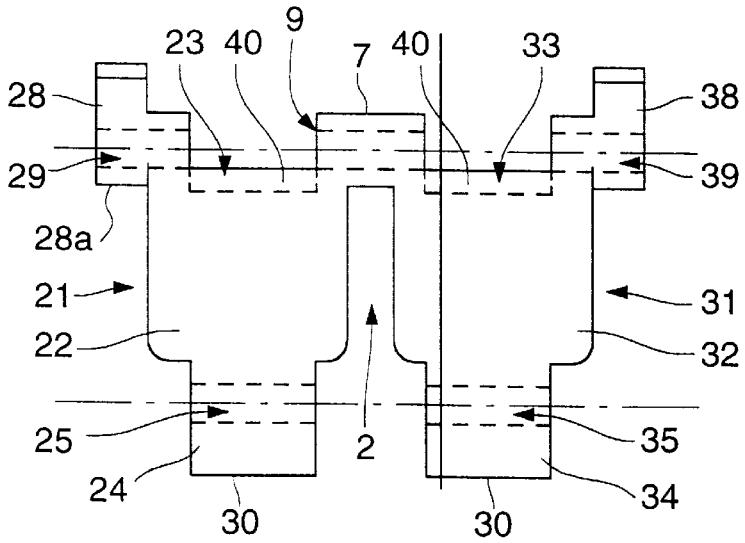
FIG. 4 is a top view of another embodiment of a link of the inner chain.
Figure 5:
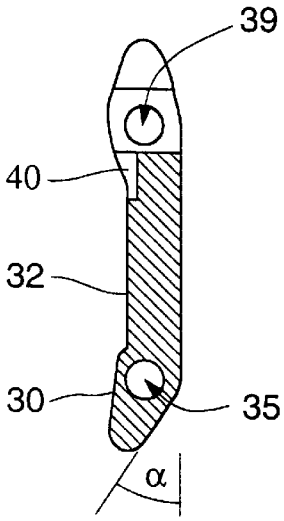
FIG. 5 is a cross-section along the line V—V of FIG. 4.

With reference now to FIGS. 4 and 5, an alternative embodiment of a link of the inner chain is shown, which differs from that which has just been described as regards the blocking means which are no longer formed by stops at the pin holes. In this variant, the blocking means are formed, for each coupling element 21, 22, by a lug 30 bent at an angle $\alpha$ towards the bottom 15 and located in the prolonged portion of each extension 23, 34. This lug 30 is provided to have a range of movement of amplitude $\alpha$ in a recess 40, of complementary shape to lug 30 and arranged in the thickness of the main body at the edge of recesses 23, 33.

The links which have just been described can be obtained by known techniques such as machining a metal blank or sandwiching a form cut out from a thin sheet of metal.

It goes without saying that various simple variants and modifications within the grasp of those skilled in the art also fall within the scope of the present invention.

What is claimed is:

1. A bracelet comprising:

enveloping decorative elements mounted along a symmetry line on a non-extensible chain, wherein each element includes two through passages delimited by a cap, a bottom, two lateral edges, and separated by a central rib, the central rib being shorter than a depth of each through passage, wherein each lateral edge and the rib connect the cap to the bottom; and articulated links forming the non-extensible chain, wherein each link is hinged to an adjacent link by a hinge including a pivot pin, and each link comprises two symmetrical coupling elements joined together by a bridge to form both sides of a central slot, wherein the central slot is complementary to and receives the central rib of a respective decorative element, and each coupling element comprises a lateral arm at one end, an extension at an opposite end, and a main body connecting the lateral arm and the extension so that the bridge is formed between the two symmetrical coupling elements of the link, wherein each coupling element has a recess disposed between the lateral arm and the bridge, wherein the recess has edges so that the edges of the recess of the link and corresponding extension of the adjacent hinged link provides a blocking means that limits an angular range of movement between the link and the hinged adjacent link to an angle $\alpha$ in a vertical plane passing through the symmetry line.

2. A bracelet according to claim 1, wherein the decorative elements comprise a single piece of a hard material.

3. A bracelet according to claim 2, wherein the hard material is ceramic.

4. A bracelet according to claim 1, wherein the blocking means includes a first annular stop disposed at each end of the bridge at one end of the link, each first annular stop having two first vertical shoulders disposed at 180° from each other and separated by a pinhole formed in the bridge, and a second annular stop disposed on each extension at an opposite end of the hinged adjacent link, each second annular stop having two second vertical shoulders disposed at an angle $\alpha$ of less than 180° from each other and separated by a pinhole formed in the extension, wherein cooperation between each first annular stop with a corresponding second annular stop limits the angular range of movement between the link and the hinged adjacent link to the angle $\alpha$ in the vertical plane passing through the symmetry line.

5. A bracelet according to claim 1, wherein each link has a bottom side and the blocking means includes a lug disposed on each extension, each lug bent to an angle $\alpha$ with respect to the bottom side, and the recess of each coupling element is contiguous with a shaped recess that has a shape complimentary to a respective lug, wherein cooperation between each shaped recess of the link with a corresponding lug of the hinged adjacent link limits the angular range of movement between the link and the hinged adjacent link to the angle $\alpha$ in the vertical plane passing through the symmetry line.

6. A bracelet comprising:

enveloping decorative elements mounted along a symmetry line on a non-extensible chain, wherein each element includes two through passages delimited by a cap, a bottom, two lateral edges, and separated by a central rib, the central rib being shorter than a depth of each through passage, wherein each lateral edge and the rib connect the cap to the bottom; and articulated links forming the non-extensible chain, wherein each link is hinged to an adjacent link by a hinge including a pivot pin, and each link comprises two symmetrical coupling elements joined together by a bridge to form both sides of a central slot, wherein the central slot is complementary to and receives the central rib of a respective decorative element, and each coupling element comprises a lateral arm at one end, an extension at an opposite end wherein the extension has a first abutment surface, and a main body connecting the lateral arm and the extension so that the bridge is formed between the two symmetrical coupling elements of the link, wherein each coupling element has a recessed edge disposed between the lateral arm and the bridge, wherein the recessed edge provides a second abutment surface so that each second abutment surface of the link and a corresponding first abutment surface of the adjacent hinged ink cooperatively engage to limit an angular range of motion between the link and the hinged adjacent link to an angle $\alpha$ in a vertical plane passing through the symmetry line.

* * * * *